US009950890B2

(12) United States Patent
Koo

(10) Patent No.: US 9,950,890 B2
(45) Date of Patent: Apr. 24, 2018

(54) MEDIUM STACKING APPARATUS, METHOD FOR STACKING A MEDIUM, AND FINANCIAL DEVICE

(71) Applicant: LG CNS CO., LTD., Seoul (KR)

(72) Inventor: Kun Hyung Koo, Seoul (KR)

(73) Assignee: LS CNS CO., LTD., Seoul (KR)

( * ) Notice: Subject to any disclaimer, the term of this patent is extended or adjusted under 35 U.S.C. 154(b) by 0 days.

(21) Appl. No.: 14/742,175

(22) Filed: Jun. 17, 2015

(65) Prior Publication Data

US 2015/0368058 A1 Dec. 24, 2015

(30) Foreign Application Priority Data

Jun. 20, 2014 (KR) ..... 10-2014-0075952

(51) Int. Cl.
*B65H 31/06* (2006.01)

(52) U.S. Cl.
CPC ..... *B65H 31/06* (2013.01); *B65H 2301/4223* (2013.01); *B65H 2301/42142* (2013.01); *B65H 2511/51* (2013.01); *B65H 2511/515* (2013.01); *B65H 2513/40* (2013.01); *B65H 2515/34* (2013.01); *B65H 2701/1912* (2013.01)

(58) Field of Classification Search
CPC ..... B65H 31/06; B65H 2301/42142
See application file for complete search history.

(56) References Cited

U.S. PATENT DOCUMENTS

| | | | | |
|---|---|---|---|---|
| 4,439,083 | A | 3/1984 | Jenkins et al. | |
| 4,678,175 | A | 7/1987 | Arldt et al. | |
| 7,677,545 | B2 * | 3/2010 | Iwami | B65H 1/025 271/153 |
| 2002/0092905 | A1 | 7/2002 | Katou et al. | |
| 2014/0284171 | A1 | 9/2014 | Lee | |

FOREIGN PATENT DOCUMENTS

| | | | |
|---|---|---|---|
| CN | 1258896 | A | 7/2000 |
| CN | 101817462 | A | 9/2010 |
| CN | 102436691 | A | 5/2012 |

(Continued)

OTHER PUBLICATIONS

Notice of Allowance dated Oct. 24, 2016 in Korean Application No. 1020140075952.

(Continued)

*Primary Examiner* — Luis A Gonzalez
(74) *Attorney, Agent, or Firm* — Saliwanchik, Lloyd & Eisenschenk

(57) ABSTRACT

A medium stacking apparatus comprises a stacking roller for stacking a medium in a stacking space, a supporting part for supporting a lower portion of the medium transferred by the stacking roller, a plurality of stacking guides for supporting the medium disposed on the supporting part in a standing state, a plurality of moving devices for moving the plurality of stacking guides, and a control part controlling the plurality of moving devices. The control part controls the plurality of moving devices to move a second stacking guide toward a first stacking guide to allow the stacked medium to stands up in a state where the medium is supported by the first stacking guide of the plurality of stacking guides.

10 Claims, 9 Drawing Sheets

(56) References Cited

FOREIGN PATENT DOCUMENTS

| | | | | |
|---|---|---|---|---|
| EP | 0061480 | B1 | | 8/1985 |
| JP | 01294168 | A | * | 11/1989 |
| JP | 2011118487 | A | * | 6/2011 |
| JP | 2012073875 | A | * | 4/2012 |
| KR | 10-2000-0006506 | A | | 1/2000 |
| KR | 20120012909 | A | | 2/2012 |
| KR | 10-2012-0078338 | A | | 7/2012 |
| WO | WO-2013022275 | A2 | | 2/2013 |

OTHER PUBLICATIONS

Office Action dated Apr. 27, 2016 in Korean Application No. 1020140075952.
Office Action dated May 2, 2017 in Chinese Application No. 201510347609.0.

* cited by examiner

MEDIUM STACKING APPARATUS, METHOD FOR STACKING A MEDIUM, AND FINANCIAL DEVICE

CROSS-REFERENCE TO RELATED APPLICATION

This application claims the benefit under 35 U.S.C. § 119 of Korean Patent Application No. 10-2014-0075952, filed Jun. 20, 2014, which is hereby incorporated by reference in its entirety.

BACKGROUND

In general, financial devices are devices for processing financial business desired by customers. The financial devices may deposit or withdraw media or automatically transfer the media. For example, the financial devices may deposit/withdraw paper moneys, checks, and the like.

A medium stacking apparatus of an automatic medium dispenser is disclosed in Korean Patent Publication No. 2010-0059139 (Published Date: Jul. 4, 2010) that is a prior document.

The medium stacking apparatus stores a medium in a standing state, i.e., vertically stores a medium. The medium stacking apparatus allows the medium introduced by a seat roller and an idle roller to be stacked in a state in which a stacking guide supports the medium.

As the number of stacked medium increases, the stacking guide moves to increase a stacking space.

However, in a typical medium stacking apparatus, when the stacking guide moves to increase the stacking space, the medium may not be transferred and fall down because a bottom surface of the medium is in contact with a stacking surface. When the medium falls down as described above, an amount of the medium stacked in the stacking space may decrease and furthermore a stacking defect may occur.

BRIEF SUMMARY

Embodiments provide a medium stacking apparatus, a method for staking a medium, and a financial device.

In one embodiment, a medium stacking apparatus comprises: a stacking roller for stacking a medium in a stacking space; a supporting part for supporting a lower portion of the medium transferred by the stacking roller; a plurality of stacking guides for supporting the medium disposed on the supporting part in a standing state; a plurality of moving devices for moving the plurality of stacking guides; and a control part controlling the plurality of moving devices. The control part may control the plurality of moving devices to move a second stacking guide of the plurality of stacking guides toward a first stacking guide of the plurality of stacking guides to allow the stacked medium to stands up in a state where the medium is supported by the first stacking guide.

In another embodiment, a method for stacking a medium comprises: moving a first stacking guide of a plurality of stacking guides to a stacking standby position to stack a medium in a stacking space; moving the first stacking guide to increase the stacking space if the number of medium supported by the first stacking guide increases; stopping the first stacking guide if a detection part detects the first stacking guide; moving a second stacking guide of the plurality of stacking guides to the stacking standby position; supporting the medium by the second stacking guide; and compressing the medium supported by the first stacking guide while the second stacking guide is moved toward the first stacking guide if the number of medium supported by the second stacking guide increases.

In further another embodiment, a financial device comprises: a customer information acquisition part for acquiring customer's information; a user interface for displaying a menu and information for depositing or withdrawing a medium or for inputting or selecting a command or information for depositing or withdrawing the medium; and a medium stacking apparatus for stacking a deposited medium or a withdrawn medium. The medium stacking apparatus may comprise a plurality of stacking guides to stack the medium in a standing state, the plurality of stacking guides stacks the medium on another stacking guide of the plurality of stacking guides if the number of medium stacking on one stacking guide of the plurality of stacking guides increases, the plurality of stacking guides are moved to be closed to compress the medium disposed between the plurality of stacking guides, and maintain a compressed state of the medium if the medium between the plurality of stacking guides is completely compressed.

DETAILED DESCRIPTION

Figure 1:
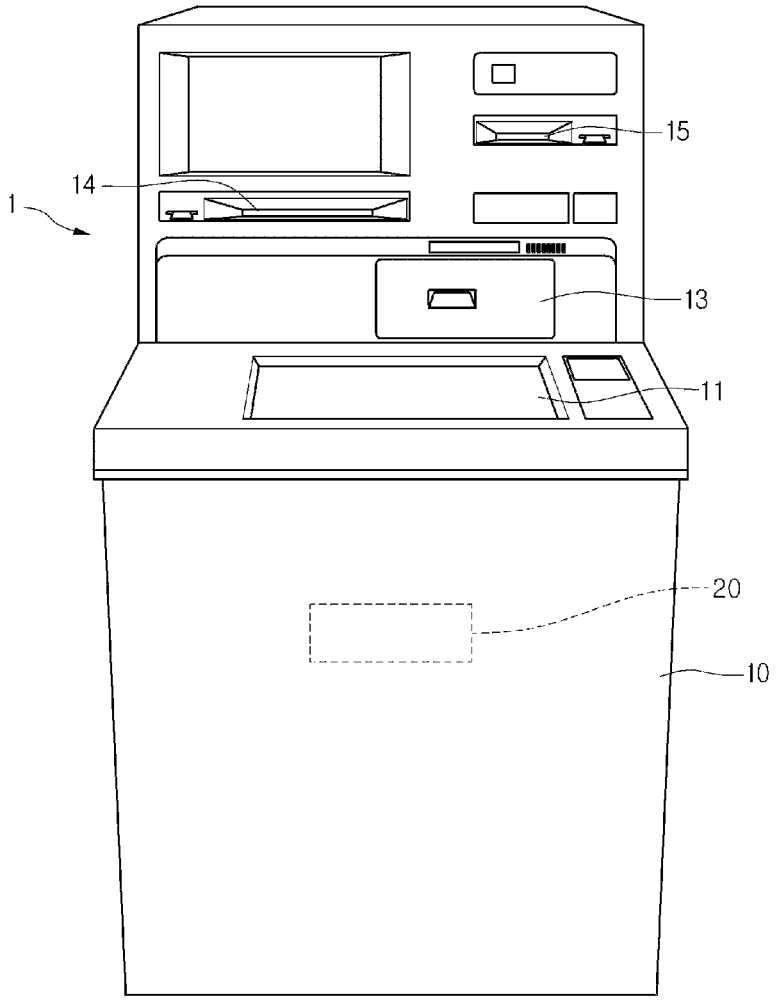
FIG. 1 is a perspective view of a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

FIG. 1 is a perspective view of a financial device according to an embodiment.

Referring to FIG. 1, a financial device 1 according to an embodiment comprises a main body 10 in which a plurality of parts are built. The main body 10 may comprise a medium entrance part 13 for depositing and withdrawing a medium.

The medium entrance part 13 may comprises a medium accommodation space that is accessible by a customer. The medium accommodation space may be opened or closed by a covering member such as a shutter and/or a cover and sometimes maintain an open state without closing.

According to a kind of financial device 1, the financial device 1 may further comprise a bankbook entrance part 14 for accepting or dispensing a bankbook and a card entrance part 15 for accepting or dispensing a card. In the current embodiment, the bankbook entrance part 14 or the card entrance part 15 may be called a customer information acquisition part for acquiring customer's information. The present disclosure is not limited to a kind of customer information acquisition part. For example, the customer information acquisition part may acquire information recorded in an RFID tag or USB or acquire customer's information by using biological information such as customer's fingerprint.

Also, the financial device 1 may further comprise a user interface part 11 for displaying a menu and information for depositing or withdrawing a medium or for inputting or selecting a command or information for depositing or withdrawing the medium.

The financial device 1 may further comprise at least one medium storage box 20 for storing a medium.

Figure 2:
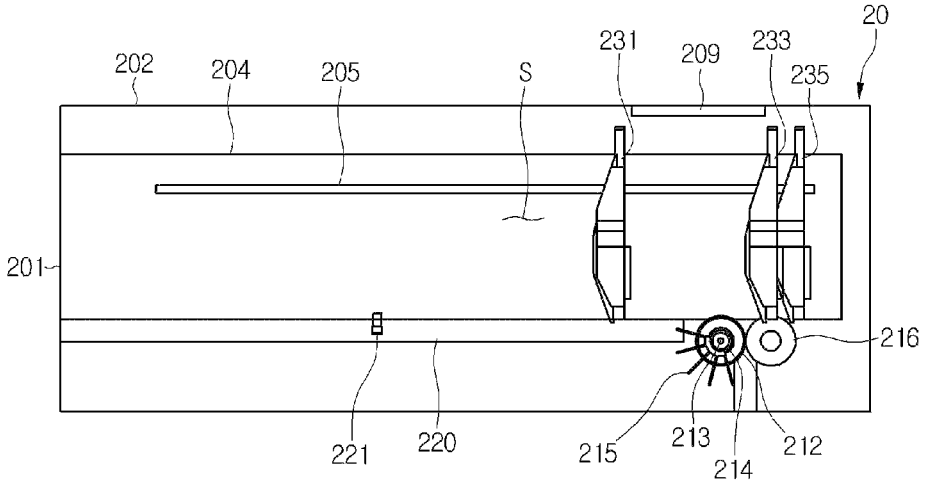
FIG. 2 is a schematic side view illustrating a medium storage box according to an embodiment.
Figure 3:
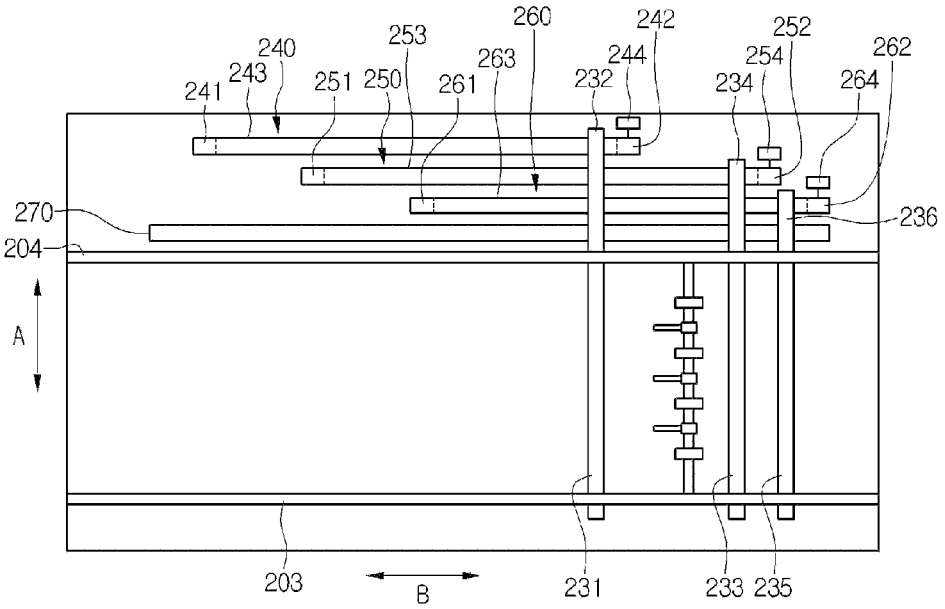
FIG. 3 is a schematic plane view illustrating a medium storage box according to an embodiment.
Figure 4:
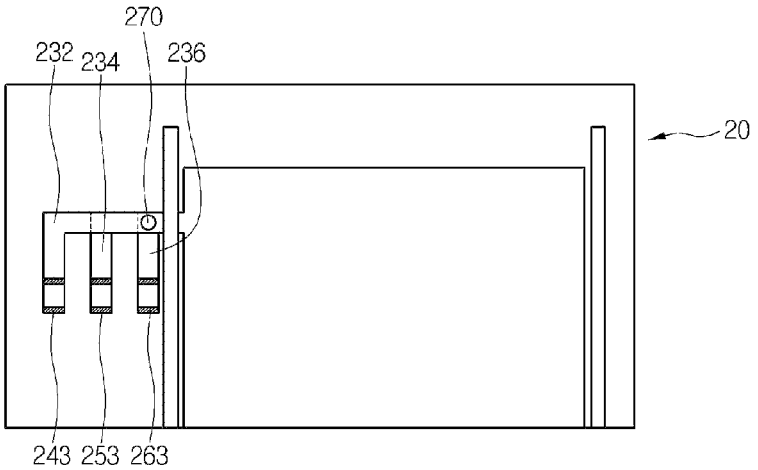
FIG. 4 is a view illustrating a relation of arrangement of a plurality of moving devices in the medium storage box in FIG. 2.

FIG. 2 is a schematic side view illustrating a medium storage box according to an embodiment, FIG. 3 is a schematic plane view illustrating a medium storage box according to an embodiment, and FIG. 4 is a view illustrating a relation of arrangement of a plurality of moving devices in the medium storage box according to an embodiment.

Referring to FIGS. 2 to 4, the medium storage box 20 according to an embodiment may vertically stack media. In the current embodiment, the vertical stacking of the media represents a case in which media are stacked at an angle of 90° with respect to a horizontal surface or stacked at an angle that is almost perpendicular to the horizontal surface.

The medium storage box 20 may comprise a box 201 having a stacking space S for stacking a medium and a door 202 opening and closing the box 201. For example, in FIG. 2, the door 202 is disposed on the box 210. The medium storage box 20 may further comprise a medium stacking apparatus for stacking a medium.

The medium stacking apparatus may comprise first and second stacking rollers 212 and 216 for transferring a medium to stack the medium.

A rotational shaft 213 to which the first stacking roller 212 is connected may be driven by a driving source that is not shown, and the second stacking roller 216 may be installed on the box 201 in an idle state. A sheet roller 214 for hitting a medium may be connected to the rotational shaft 213. A plurality of contact parts 215 may be disposed on the sheet roller 214 in a circumferential direction.

The medium stacking apparatus may further comprise a supporting part 220 supporting a lower portion of a medium and a plurality of stacking guides 231, 233, and 235 supporting a side surface or top end of the medium to vertically stack the medium. A medium transferred upward by each of the stacking rollers 212 and 216 is bumped to a damper 209 and then transferred downward by the self-weight, and one of the plurality of contact parts 215 hits the medium so that the medium is supported by one of the plurality of stacking guides 231, 233, and 235. Here, at least one of the plurality of stacking guides 231, 233, and 235 may be disposed on an inclined guide surface thereunder so that the medium transferred by the first and second stacking rollers 212 and 216 is bumped to the damper 209 and then stacked on the supporting part 220 in a standing state without interfering with other media. Also, an intermediate portion of at least one of the plurality of stacking guides 231, 233, and 235 may have a flat shape in order to effectively compress the medium.

A detection part 221 for detecting one of the plurality of stacking guides 231, 233, and 235 may be disposed on the supporting part 220.

The plurality of stacking guides 231, 233, and 235 may comprise first, second, and third stacking guides 231, 233, and 235. In this specification, the number of stacking guide may increase as the stacking space increases, and two stacking guides may be provided if the stacking space S decreases. For example, three stacking guides are shown in FIG. 2.

The medium stacking apparatus may comprise two side guides 203 and 204 defining both side surfaces of the stacking space S. One portion of each of the stacking guides 231, 233, and 235 may be disposed between the two side guides 203 and 204, i.e., in the stacking space, and the other portion may pass through one of the two side guides 203 and 204 and disposed outside one of the side guide, i.e., outside the stacking space.

The medium stacking apparatus may further comprise a plurality of moving devices 240, 250, and 260 for moving each of the stacking guides 231, 233, and 234 in a horizontal direction (see an arrow B in a left/right direction in FIG. 3).

The plurality of moving devices 240, 250, and 260 may comprise may comprise a first moving device 240 for moving the first stacking guide 231, a second moving device 250 for moving the second stacking guide 233, and a third moving device 260 for moving the third stacking guide 235. In this specification, the number of moving device may be equal to that of the stacking guide. Accordingly, in the current embodiment, each of the stacking guides 231, 233, and 235 may be moved independently or associately. The plurality of stacking guides 231, 233, and 235 may comprise connection parts 232, 234, and 236 disposed outside the stacking space S and connected to the moving devices 240, 250, and 260, respectively.

The medium stacking apparatus may further comprise a guide bar 270 passing through the connection parts 232, 234, and 236 of the stacking guides 231, 233, and 235. Accordingly, each of the stacking guides 231, 233, and 235 may be horizontally moved along the guide bar 270, and thus each of the stacking guides 231, 233, and 235 may be stably moved in a horizontal direction.

Here, since each of the stacking guides 231, 233, and 235 is moved in a state in which each of the stacking guides 231, 233, and 235 passes through one side surface of two side guides, a slot 205 having a horizontally long shape may be defined in one of side guides. Accordingly, since the slot 205 guides the horizontal movement of each of the stacking guides 231, 233, and 235, the guide bar 270 may be removed. Alternatively, one of the two side guides 203 and 204 may be removed, and the guide bar 270 may function as a side guide.

The first moving device 240 may comprise two pulleys 241 and 242, a first belt 243 surrounded by the two pulleys 241 and 242, and a first driving part 244 for driving one of the two pulleys 241 and 242. The first belt 243 may be connected to the connection part 232 of the first stacking guide 231.

The second moving device 250 may comprise two pulleys 251 and 252, a second belt 253 surrounded by the two pulleys 251 and 252, and a second driving part 254 for driving any one of the two pulleys 251 and 252. The second belt 253 may be connected to the connection part 233 of the second stacking guide 233.

The third moving device 260 may comprise two pulleys 261 and 262, a third belt 263 surrounded by the two pulleys 261 and 262, and a third driving part 264 for driving any one of the two pulleys 261 and 262. The third belt 263 may be connected to the connection part 236 of the third stacking guide 235.

In the current embodiment, each of the moving devices 240, 250, and 260 may be spaced in a width direction (see an arrow B direction in FIG. 3) of the medium storage box 20 so that the moving devices 240, 250, and 260 do not interfere with each other while each of the moving devices 240, 250, and 260 operates.

Figure 5:
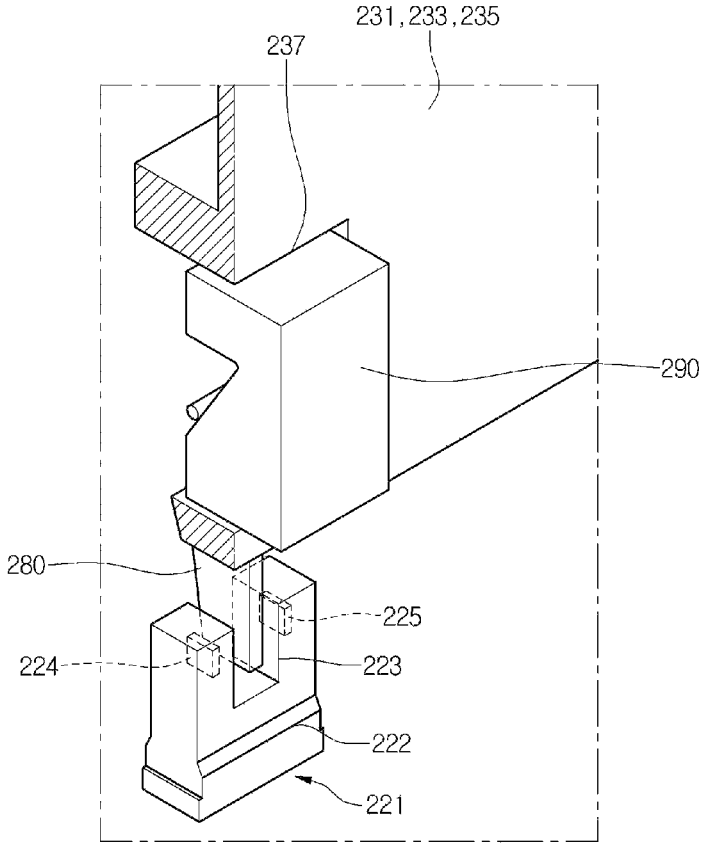
FIGS. 5 and 6 are views illustrating a unit for detecting an amount of compression of a medium according to an embodiment.
Figure 6:
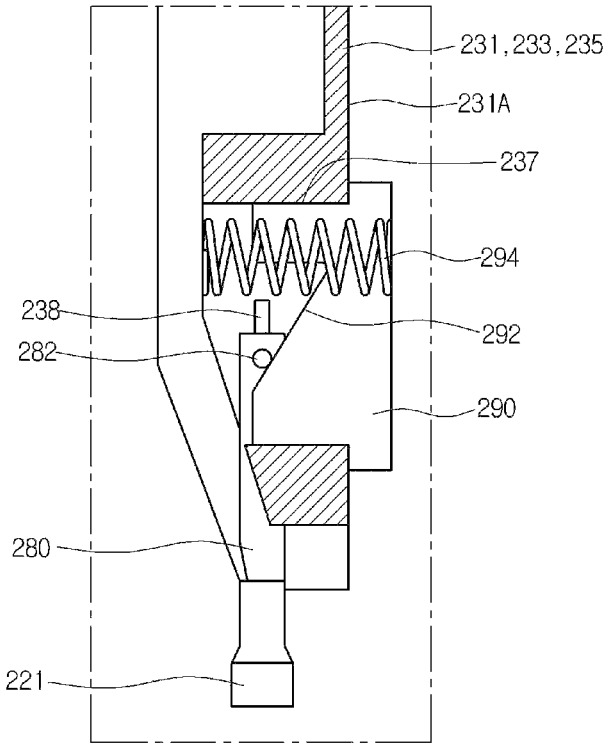

FIGS. 5 and 6 are views illustrating a unit for detecting an amount of compression of a medium according to an embodiment.

Referring to FIGS. 5 and 6, an unit for detecting an amount of compression (hereinafter, referred to as a compression amount detection unit) may be installed on at least one of the plurality of stacking guides to detect a compression amount of media compressed between two stacking guides adjacent to each other. The movement of the plurality of stacking guides may be controlled on the basis of the compression amount detected by the compression amount detection unit. For example, when the compression amount is equal to or greater than a preset compression amount, it may be determined that media are compressed by the plurality of stacking guides The compression amount detection unit may comprise a first movable member 280, a second movable member 290, and an elastic member 294 elastically supporting the second movable member 290.

The first movable member 280 is installed on each of the stacking guides 231, 233, and 235 to move in a vertical direction, and the second movable member 290 is installed on each of the stacking guides 231, 233, and 235 to move in a horizontal direction.

An accommodation part 237 in which the second movable member 290 is located is disposed on each of the stacking guides 231, 233, and 235, and a guide slot 238 guiding vertical movement of a pin 282 passed through the first movable member 280 is disposed in the accommodation part 237. The guide slot 238 may be a long hole that is formed in a vertical direction.

The elastic member 294 may have one end fixed to each of the stacking guides 231, 233, and 235 and the other end fixed to the second movable member 290. The second movable member 290 protrudes from a contact surface 231A, which contacts the medium, of each of the stacking guides 231, 233, and 235. Accordingly, the second movable member 290 may contact the medium stacked on the supporting part 220.

A groove 292 for accommodating the pin 282 may be defined in the second movable member 290. The groove 292 may comprise an inclined surface for lifting the pin 282 if the second movable member 290 is compressed by a medium. If the pin is lifted along the inclined surface, the first movable member 280 is lifted by the pin 282.

The detection part 221 may detect each of the stacking guides 231, 233, and 235 during each of the stacking guides 231, 233, and 235 is moved.

The detection part 221 may comprise a sensor supporter 222 having an accommodation hole 233 for accommodating a lower portion of the first movable member 280 and a light emitting sensor 224 and a light receiving sensor 225, which are installed on the sensor supporter 222. The light sensors 224 and 225 may be respectively disposed on sides opposite to each other with reference to the accommodation hole 223.

During each of the stacking guides 231, 233, and 235 is moved in a horizontal direction, the first movable member 280 may be disposed in the accommodation hole 222 of the sensor supporter 221, and, in this case, light emitted from the light emitting sensor 224 is blocked by the first movable member 280 not to reach to the light receiving sensor 225.

Hereinafter, a process of stacking a medium in a medium storage box according to an embodiment will be described.

Figure 7:
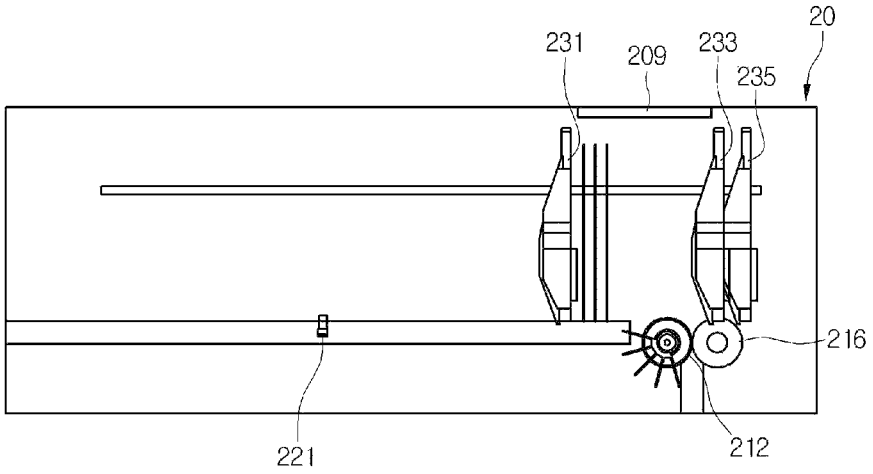
FIG. 7 is a view illustrating a state in which a medium is supported by a first stacking guide.
Figure 8:
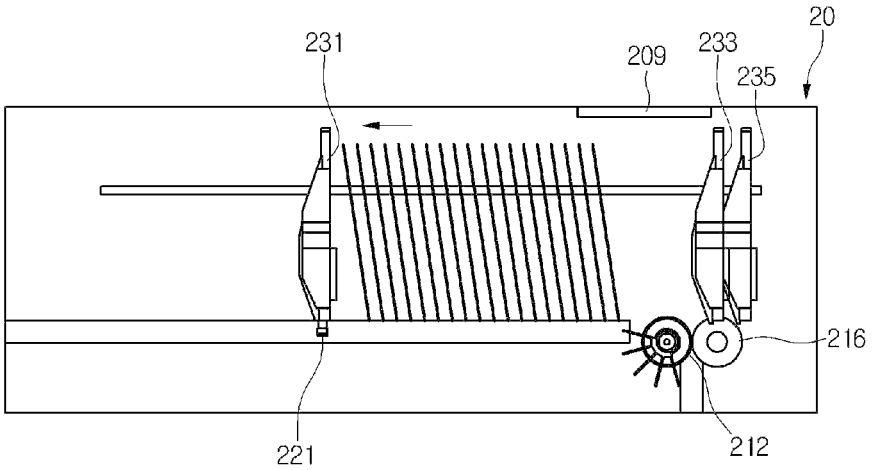
FIG. 8 is a view illustrating a state in which the first stacking guide is moved to increase a stacking space.
Figure 9:
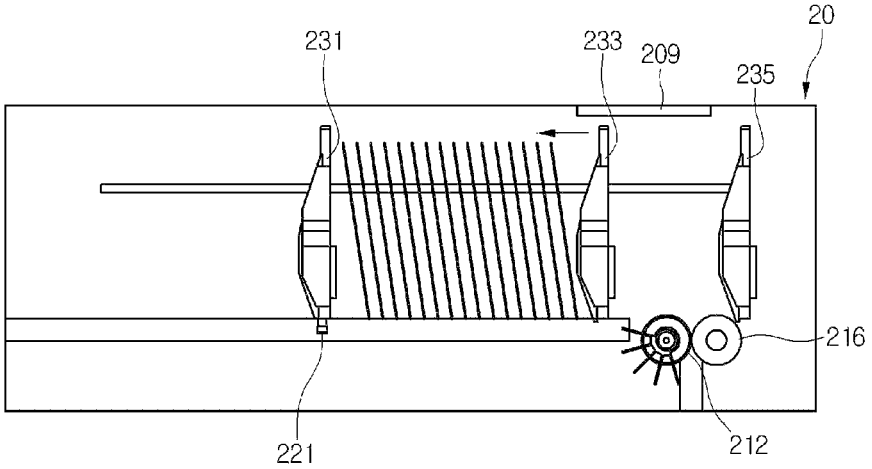
FIG. 9 is a view illustrating a state in which a second stacking guide is moved to compress a medium supported by the first stacking guide.
Figure 10:
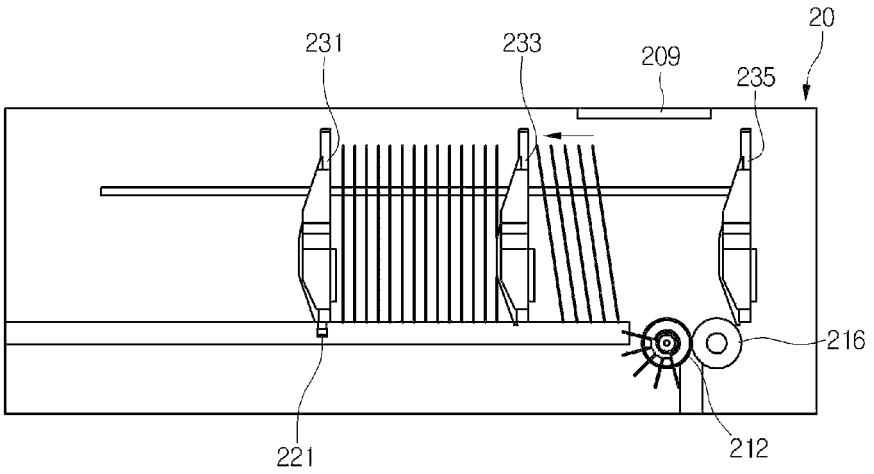
FIG. 10 is a view illustrating a state in which a medium supported by the first stacking guide is compressed by the second stacking guide.
Figure 11:
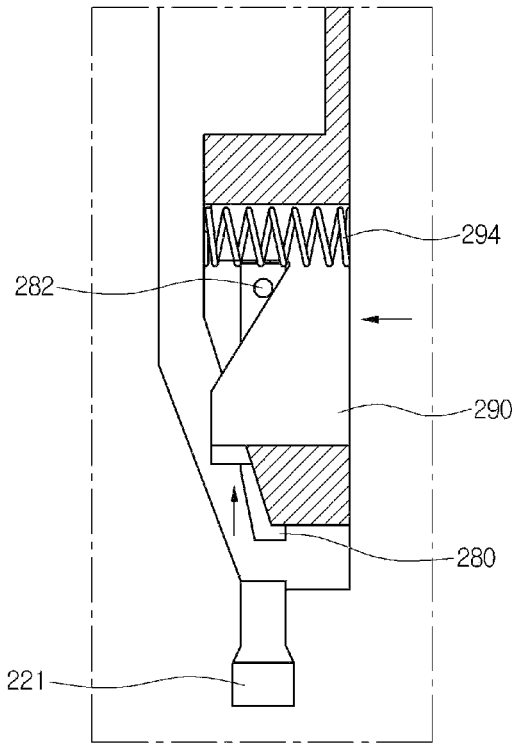
FIG. 11 is a view illustrating a state in which a second movable member of the first stacking guide is compressed by the medium.
Figure 12:
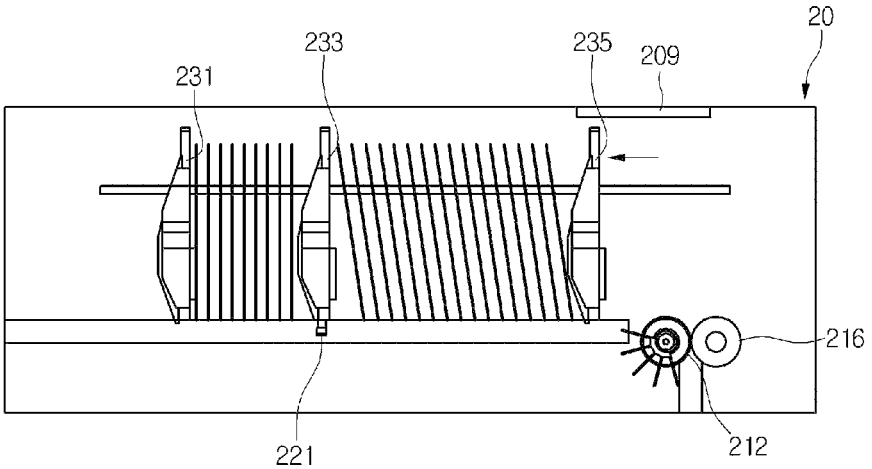
FIG. 12 is a view illustrating a state in which a third stacking guide moves to compress a medium supported by the second stacking guide.
Figure 13:
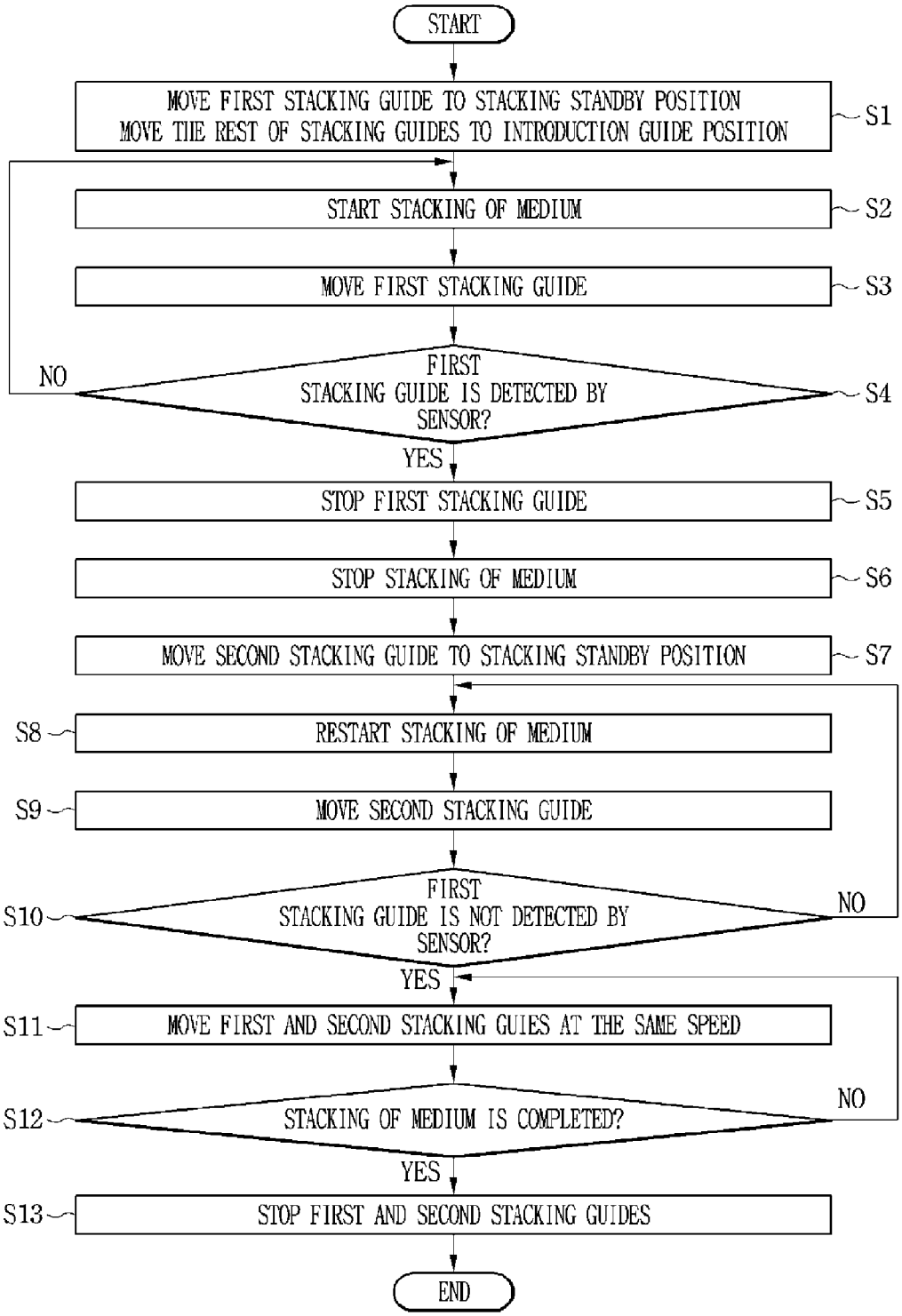
FIG. 13 is a flowchart for explaining a method for stacking a medium in a medium storage box according to an embodiment.

FIG. 7 is a view illustrating a state in which a medium is supported by a first stacking guide, FIG. 8 is a view illustrating a state in which the first stacking guide is moved to increase a stacking space, FIG. 9 is a view illustrating a state in which a second stacking guide is moved to compress a medium supported by the first stacking guide, FIG. 10 is a view illustrating a state in which a medium supported by the first stacking guide is compressed by the second stacking guide, FIG. 11 is a view illustrating a state in which a second movable member of the first stacking guide is compressed by the medium, FIG. 12 is a view illustrating a state in which a third stacking guide moves to compress a medium supported by the second stacking guide, and FIG. 13 is a flowchart for explaining a method for stacking medium in a medium storage box according to an embodiment.

Although the medium stacking apparatus comprises three stacking guides, an operation of two stacking guides will be described in FIG. 13 for convenience of description, and the rest of stacking guides may be operated in the same way as the first and second stacking guides.

Also, a process of stacking a medium in a state in which a medium does not exist in the accommodation space S will be described.

Referring to FIGS. 7 and 13, the first stacking guide 231 moves to a stacking standby position to stack a medium in the accommodation space S and the rest of stacking guides moves to an introduction guide position (S1). In this state, a stacking of medium starts (S2).

In the current embodiment, the stacking standby position represents a position at which the stacking guide supports the medium, and the introduction guide position represents a position in which a vertical movement of the medium (a stacking of the medium) is guided when the medium is transferred by each of stacking rollers. Here, when the stacking guides 231, 233, and 235 are disposed on the introduction guide position, an inclined guide surface may be provided on a lower portion of the stacking to guide the medium.

If the number of medium stacked in the stacking space S increases, the first stacking guide 231 moves to a direction that is away from each of the stacking rollers 212 and 216 (a left direction in FIG. 8) to increase the stacking space S as illustrated in FIG. 8 (S3). That is, a control part (not shown) controls the first driving part 244 to allow the first stacking guide 231 to move toward a left side in the figure.

During the first stacking guide 231 moves in a left direction, a control part (not shown) determines whether the first stacking guide 231 is detected by the detection part 221 (S4). That is, the control part determines whether the first movable member 280 of the first stacking guide 280 is detected by the detection part 221.

According to the result determined in the operation S4, if the detection part 221 determines that the first movable member 280 of the first stacking guide 231 is detected, the control part controls the first driving part 244 to stop the first stacking guide 231. In this specification, a position to which the first stacking guide 231 is stopped may be called a compression standby position.

Also, the control part stops a stacking of a medium (S6). After that, the control part controls the second driving part 254 to move the second stacking guide 233 to the stacking standby position is illustrated in FIG. 9 (S7). That is, the control part may control the second driving part 254 to move the second stacking guide 233 and then stop the second stacking guide 233. After that, the control part restarts a stacking of a medium (S8).

As illustrated in FIG. 10, if the number of a medium supported by the second stacking guide 233 increases, the second stacking guide 233 moves toward the first stacking guide 231. If the second stacking guide 233 moves toward the first stacking guide 231, media between the first stacking guide 231 and the second stacking guide 233 are erected and compressed by the second stacking guide 233.

As illustrated in FIG. 11, if the media are compressed over a predetermined pressure or more by the second stacking guide 233, the media compress the second movable member 290 of the first stacking guide 231 to the left side. When the second movable member 290 is compressed to the left side, the first movable member 280 ascends. If the first movable member 280 is lifted, the detection part 221 may not sense the first stacking guide 231, i.e., the first movable member 280.

The control part determines whether the first stacking guide 231 is not detected by the detection part 221 while the second stacking guide 233 moves (S10).

According to the result determined in of the operation S10, if it is determined that the first stacking guide 231 is not detected by the detection part 221, the control part controls the first driving part 244 and the second driving part 254 to associate with each other in order to maintain the media between the first and second stacking guides 231 and 233 in the compressed state and move the first and second stacking guides 231 and 233 at the same movement speed.

In the current embodiment, if the first stacking guide 231 is not detected by the detection part 221 while the second stacking guide 233 moves, the media supported by the first stacking guide 231 are completely compressed.

The control part determines whether the stacking of the medium is completed (S12). When the stacking is completed, the control part controls the first and second driving parts 244 and 254 to stop the first and second stacking guides 231 and 233 (S13).

If the detection part 221 senses the second stacking guide 233 during the first and second stacking guides 231 and 233 are associated and moved at the same speed in a state of FIG. 10, the third stacking guide 235 is moved to the stacking standby position and prior processes are repeated.

According to the suggested embodiment, since the medium stacked in the stacking space maintains a standing state, the number of medium stacked in the stacking space may be maximized, and the medium may be smoothly stacked.

In the current embodiment, if the second stacking guide 233 is disposed on a position of the insertion guide and the stacking of medium is completed while the first stacking guide 231 moves to increase the stacking space, the first stacking guide 231 may be stopped. When the stacking of medium is started by the next job, the first stacking guide 231 may move again from the stopped position.

Alternatively, if the stacking of medium is completed in the state in which the first stacking guide 231 is not detected by the detection part 221, the control part moves the first stacking guide until the detection part 221 detects the first stacking guide 231 and then allows the first stacking guide 231 to stop. When the stacking of medium is started by the next job, the second stacking guide 233 may move to the stacking standby position, and then the stacking of medium may be restarted.

Although the medium stacking apparatus is disposed in the medium storage box in the above-described embodiment, the medium stacking apparatus may also be applied in the medium entrance part.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or include or has) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium stacking apparatus, comprising:

a stacking roller for stacking a medium in a stacking space;

a supporting part for supporting a lower portion of the medium transferred by the stacking roller;

a plurality of stacking guides for supporting the medium disposed on the supporting part in a standing state;

a plurality of moving devices for moving the plurality of stacking guides;

a detection part for detecting positions of the plurality of stacking guides; and a control part controlling the plurality of moving devices, wherein the control part controls the plurality of moving devices to move a second stacking guide of the plurality of stacking guides toward a first stacking guide of the plurality of stacking guides to allow the stacked medium to stand up in a state in which the medium is supported by the first stacking guide, and wherein an additional medium introduced into the stacking space is supported by the second stacking guide after the second stacking guide moves toward the first stacking guide to allow the stacked medium to stand up, wherein the plurality of moving devices comprises a first moving device for moving the first stacking guide and a second moving device for moving the second stacking guide, wherein the control part controls the first moving device to move the first stacking guide to increase the stacking space if number of media stacked in the stacking space increases in a state in which media are supported by the first staking guide, and wherein the control part controls the first moving device to stop the first stacking guide and controls the second moving device to move the second stacking guide toward the first stacking guide if the detection part detects the first stacking guide.

2. The medium stacking apparatus of claim 1, wherein the control part controls the second moving device to stop the second stacking guide after the second stacking guide is moved a predetermined distance toward the first stacking guide, and the medium is supported by the second stacking guide in a state in which the second stacking guide is stopped.

3. The medium stacking apparatus of claim 2, wherein, when the number of media supported by the second stacking guide increases, the control part controls the second moving device to move the second stacking guide toward the first stacking guide to increase the stacking space.

4. The medium stacking apparatus of claim 2, wherein the control part controls the second moving device to move the second stacking guide toward the first stacking guide to compress the medium supported by the first stacking guide.

5. The medium stacking apparatus of claim 4, wherein the first stacking guide is maintained in the stopped state while the second stacking guide is moved toward the first stacking guide.

6. The medium stacking apparatus of claim 1, wherein the second stacking guide comprises an inclined guide surface to guide the medium to be stacked on the supporting part.

7. A medium stacking apparatus, comprising:

a stacking roller for stacking a medium in a stacking space;

a supporting part for supporting a lower portion of the medium transferred by the stacking roller;

a plurality of stacking guides for supporting the medium disposed on the supporting part in a standing state;

a plurality of moving devices for moving the plurality of stacking guides;

a compression amount detection unit for detecting a compression amount of the medium; and a control part controlling the plurality of moving devices, wherein the control part controls the plurality of moving devices to move a second stacking guide of the plurality of stacking guides toward a first stacking guide of the plurality of stacking guides to allow the stacked medium to stand up in a state in which the medium is supported by the first stacking guide, wherein an additional medium introduced in the stacking space is supported by the second stacking guide after the second stacking guide moves toward the first stacking guide to allow the stacked medium to stand up, wherein the plurality of moving devices comprises a first moving device for moving the first stacking guide and a second moving device for moving the second stacking guide, wherein the control part controls the first moving device to move the first stacking guide to increase the stacking space if number of media stacked in the stacking space increases in a state in which media are supported by the first stacking guide, and wherein the controller unit controls the first and second stacking guides to move the first and second stacking guides at a same speed if the compression amount detection unit detects a predetermined compression amount or another medium is supported by the first stacking guide in a state in which the first stacking guide is stopped.

8. The medium stacking apparatus of claim 7, further comprising a detection part, wherein, when the detection part detects the second stacking guide, the control part controls the first and second moving devices to stop the first and second stacking guides.

9. The medium stacking apparatus of claim 7, wherein the compression amount detection unit is disposed in the second stacking guide.

10. The medium stacking apparatus of claim 7, wherein the compression amount detection unit comprises:

a first movable member movably coupled with the first stacking guide in a vertical direction with respect to a compression direction of the medium, a second movable member movably coupled with the first stacking guide in a horizontal direction with respect to the compression direction of the medium to lift the first movable member if the second movable member is compressed by the medium, and an elastic member for elastically supporting the second movable member, wherein the detection part detects the first movable member to detect positions of the plurality of stacking guides.

* * * * *